US007825347B2

(12) United States Patent
Schwarz et al.

(10) Patent No.: US 7,825,347 B2
(45) Date of Patent: Nov. 2, 2010

(54) ELECTRIC ROTARY SWITCH

(75) Inventors: Sebastian Schwarz, Fuerfeld (DE); Gerd Rudolph, Aspisheim (DE)

(73) Assignee: Delphi Technologies, Inc., Troy, MI (US)

( * ) Notice: Subject to any disclaimer, the term of this patent is extended or adjusted under 35 U.S.C. 154(b) by 1080 days.

(21) Appl. No.: 10/554,881

(22) PCT Filed: Mar. 11, 2004

(86) PCT No.: PCT/DE2004/000479

§ 371 (c)(1),
(2), (4) Date: Sep. 18, 2006

(87) PCT Pub. No.: WO2004/097876

PCT Pub. Date: Nov. 11, 2004

(65) Prior Publication Data

US 2007/0051594 A1 Mar. 8, 2007

(30) Foreign Application Priority Data

Apr. 30, 2003 (DE) ..... 103 19 383

(51) Int. Cl.
*H01H 19/14* (2006.01)
*H01H 13/62* (2006.01)

(52) U.S. Cl. ..... 200/566; 200/564

(58) Field of Classification Search ... 200/11 R–11 DA, 200/520–528, 564–571
See application file for complete search history.

(56) References Cited

U.S. PATENT DOCUMENTS 3,100,404 A * 8/1963 Boeddeker et al. ..... 74/553
3,218,401 A * 11/1965 Root ..... 200/11 C
4,052,573 A * 10/1977 Kojima et al. ..... 200/11 DA
4,445,010 A * 4/1984 Feinbloom et al. ..... 200/11 R
4,733,035 A * 3/1988 Ohashi ..... 200/568
4,742,187 A * 5/1988 Sorenson ..... 200/11 J
4,876,416 A * 10/1989 Frantz et al. ..... 200/11 R
4,916,276 A * 4/1990 Sasaki ..... 200/524
5,384,442 A * 1/1995 Danner ..... 200/566
5,406,041 A * 4/1995 Hahn et al. ..... 200/61.86
5,801,346 A * 9/1998 Taniuchi ..... 200/11 K
5,819,597 A * 10/1998 Sato et al. ..... 74/553
5,967,301 A * 10/1999 Reed et al. ..... 200/523
5,991,149 A 11/1999 Tsuneaki et al.
6,225,580 B1 * 5/2001 Lemire ..... 200/11 DA
6,410,871 B1 * 6/2002 Rarbach ..... 200/336
6,797,907 B1 * 9/2004 Meagher et al. ..... 200/564

(Continued)

FOREIGN PATENT DOCUMENTS

DE 443206 4/1927

(Continued)

*Primary Examiner*—Michael A Friedhofer
(74) *Attorney, Agent, or Firm*—Thomas N. Twomey

(57) ABSTRACT

The invention relates to an electric rotary switch comprising a switching rotary unit (5) arranged in a housing provided with at least one switching contact (13) acting on switching contact paths (2) associated to socket (1). The rotary switching unit (5) is coupled with an actuating element (8) and interacts with a locking sleeve (9), bevel (10), or indentation (11) for determining switching positions. The locking sleeve (9), bevel (10), or indentation (11) are associated, in part with a face oriented towards the socket (1) of the rotary switching unit, and in part with the rotary switching unit.

9 Claims, 4 Drawing Sheets

U.S. PATENT DOCUMENTS

| | | | | |
|---|---|---|---|---|
| 6,900,406 | B2 * | 5/2005 | Huber | 200/566 |
| 7,205,492 | B1 * | 4/2007 | Corcino et al. | 200/43.13 |
| 7,511,241 | B1 * | 3/2009 | Magda | 200/565 |
| 7,582,841 | B2 * | 9/2009 | Kim | 200/566 |

FOREIGN PATENT DOCUMENTS

| | | |
|---|---|---|
| DE | 2016992 | 11/1970 |
| DE | 19832089 | 1/2000 |
| DE | 10123536 | 1/2003 |

* cited by examiner

ELECTRIC ROTARY SWITCH

BACKGROUND OF THE INVENTION

1. Technical Field

The invention relates to an electric rotary switch with a rotary switching unit, which is mounted in a housing and which comprises switch contacts for acting on switch contacts assigned to a base, wherein the rotary switching unit is coupled to an actuation element and interacts with means for determining switch positions.

2. Background Art

DE 40 08 248 C1 discloses an electric rotary switch with a housing; a switch part, which is held so that it can rotate in the housing, which can be brought into various switch positions by means of an actuation element, and which cooperates with switch contact parts in the housing; as well as at least one moving catch element, which is assigned to the switch part and which is acted upon by a spring element; and a catch device, which is arranged in the region of the side walls of the housing, which cooperates with the moving catch element, and which has at least two catch curves, wherein the rotary switch is constructed such that through the change in position of at least one of its components, other switch functions can be realized. The catch device is embodied such that by changing its position in the switch housing, either one catch curve or the other is assigned to at least one moving catch element. The switch part is provided with a switch body, which triggers certain switch functions in a first position, which causes different switch functions in a second position that is changed relative to the first position, and which is assigned to the switch contact parts. Two movable catch elements, which are held so that they can be displaced diametrically in a recess of the switch part and which are acted upon by the spring force of a spiral compression spring, are assigned to the catch device. This rotary switch has a relatively complex construction and requires a large amount of installation space.

Furthermore, from DE 36 02 246 C1, an electric switch, especially a rotary switch, is known, whose electric contact elements can be influenced by means of an actuation element, which is assigned, on its side, to a catch device, which comprises a catch curve and also at least one spring-loaded catch element interacting with the catch curve and which can be brought into at least one operating switch position from a catching rest switch position. The catch curve of the catch device has the shape of a logarithmic spiral of a definite type.

Furthermore, DE 198 12 251 C2 shows an electric rotary switch with a housing, which holds stationary and movable electric contact elements and which comprises a base part and a cover part, and with at least one switch part, which can be rotated in the housing by means of an actuation element into several different switch positions and which cooperates with the movable contact elements in the housing, wherein at least one plate-like cam disk, whose cams, when actuated, can be brought into contact with plungers arranged so that they can move in the housing and which are in direct contact, on the other side, with at least one of the movable electric contact elements, is provided on at least the switch part mounted so that it can move in the housing. The plungers can be guided only in the longitudinal direction on the movable contact elements due to guide recesses in the base part of the housing and the plungers to be actuated by the cams are formed by means of thin, flexible connecting pieces as integral components hinged to a control disk.

SUMMARY OF THE INVENTION

The object of the invention is to create a rotary switch of the type named above, which requires little installation space with a simple construction.

According to the invention, the object is achieved in that the means for defining switch positions are allocated in part, to the end side of the rotary switch element pointing in the direction of the base and, in part, to the base.

Due to the axial orientation of the means for defining the switch positions of the rotary switch in the region of the rotary switching unit, the rotary switch requires only minimal installation space, which is determined essentially by the dimensioning of the rotary switching unit.

Preferably, as means there is a compression spring-loaded locking sleeve in a first dome of the rotary switching unit. This sleeve interacts with at least one indentation or stopping bevel on the base side. Due to the different configuration of the base, namely, first with indentations and second with stopping bevels, either latched rotary switches or keyed rotary switches can be produced with identically configured rotary switching units. Here, the number of base-side indentations gives the number of switch positions. The stopping bevels of the keyed rotary switch impart a tactile switching sensation to the user.

Preferably, a projection of the switch contact is held in a compression spring-loaded manner in a second dome of the rotary switching unit. Thus, for guaranteed functionality, the rotary switching unit features a relatively simple construction. The geometry of the switch contact corresponds to one section of a circular ring, in order to bypass assigned switch contact traces, for example, of a printed pattern or a circuit board, when the actuation element or the rotary switching unit rotates. The assigned switch functions cause, for example, dimming of instrument lighting for a motor vehicle or height adjustments to motor vehicle headlights.

To guarantee the transfer of the rotational movement of the actuation element to the rotary switching unit with simple means, preferably the rotary switching unit is provided with a recess for rotationally locked holding of the actuation element.

To realize a positive lock between the actuation element and the rotary switching unit, as well as for transfer of the forces occurring when the actuation element rotates, advantageously a tab engaging in the recess is formed on the actuation element.

According to an advantageous improvement of the inventive concept, the actuation element is mounted so that it can move axially, such that it closes flush with an upper edge of the housing in the bottom end position and projects past the upper edge of the housing in the top end position. This type of axial support of the actuation element is realized, first, for optical reasons and, second, for functional reasons. If the actuation element is located in its bottom end position, for example, inadvertent application of force to this element is excluded and other actuation elements in its direct vicinity can be actuated without a problem, because, for this purpose, the necessary free space is created by the embedding of the actuation element in the housing.

In the configuration of the invention, the actuation element is supported on the base in a compression spring-loaded manner and has a cardioid-shaped curve, in which a pin fixed to the rotary switching unit engages, in order to hold the actuation element in the bottom end position when pressure is applied and to release it again when pressure is applied again. Due to this configuration, the locking of the actuation element in its bottom end position and its release for displacement into its top end position is guaranteed by applications of pressure with a small number of individual parts.

Preferably, the pin has an S shape, wherein one end is fixed in the recess of the rotary switching unit and the other end extends above the rotary switching unit into the cardioid-shaped curve of the actuation element. Preferably, the cardioid-shaped curve is formed in the tab of the actuation element. For reliable support or guidance, the actuation element preferably has a projection, which engages in the recess of the rotary switching unit and whose cross section has a semicircular ring shape. Preferably, a compression spring, which is supported, in part, on a connecting piece of the base and, in part, with an intermediate arrangement of a cap on the actuation element, is inserted into the center of the projection. The cap protects the actuation element from damage by the compression spring.

To assign another function to the cap, preferably the cap is embodied as an optical fiber for backlighting of a symbol of the actuation element. The necessary light source can be assigned, for example, to the base.

Advantageously, the projection of the actuation element is inserted into a recess of the base in its bottom end position, in order to block rotation of the actuation element. Accordingly, the protection against rotation of the actuation element is realized with simple means without additional components.

In order to hold the actuation element in the housing, the actuation element preferably has an annular shoulder, which contacts the housing in the top position of the actuation element, between the projection and a gripping surface with a cylindrical cross section. The annular shoulder also limits the displacement of the actuation element in the direction of the base, because it comes to lie on the rotary switching unit. In this way, damage of the pin engaging in the cardioid-shaped curve of the actuation element is also excluded.

It is understood that the features named above and features still to be explained below can be applied not only in the indicated combinations, but also in other combinations. The scope of the present invention is defined only by the claims.

BRIEF DESCRIPTION OF THE DRAWINGS

The invention is explained in more detail below using two embodiments with reference to the associated drawings. Shown are.

DETAILED DESCRIPTION OF THE PREFERRED EMBODIMENTS

Figure 1:
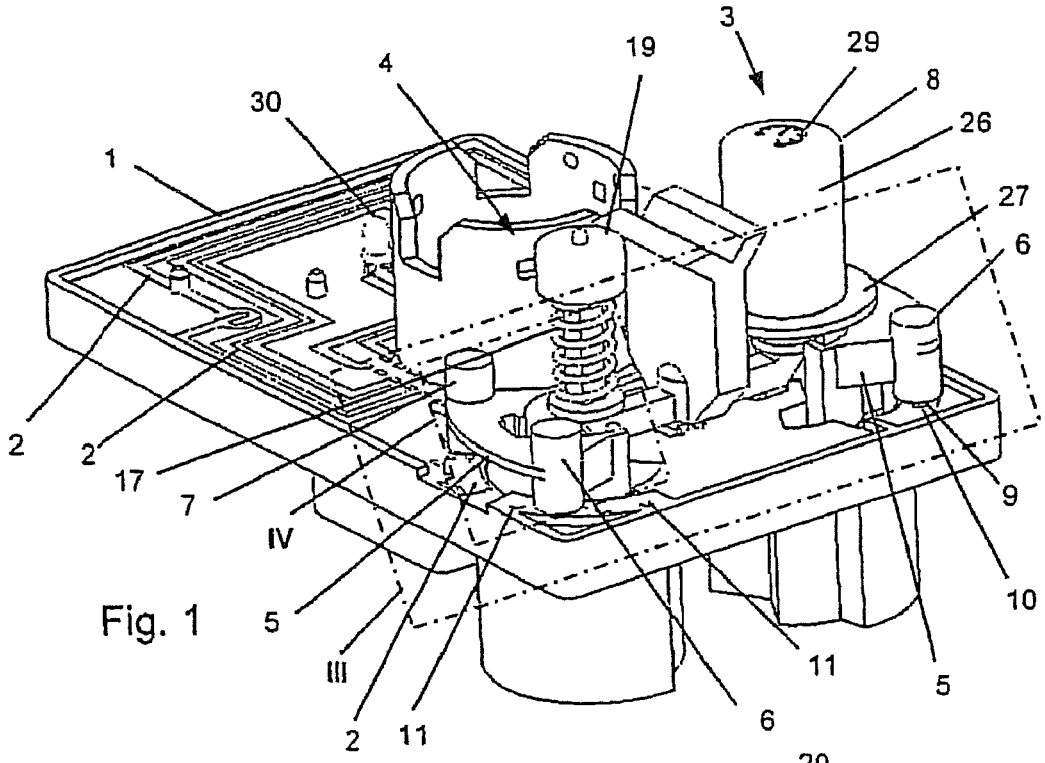
FIG. 1, a perspective partial view of a switch unit with two rotary switches according to the invention, FIG. 2, a perspective partial view of the rotary switch from FIG. 1, FIG. 3, a perspective view of a detail III from FIG. 1, FIGS. 4 and 5, perspective views of an enlarged detail IV from FIG. 1, FIGS. 6 and 7, perspective views of an actuation element of the rotary switch from FIG. 1
Figure 2:
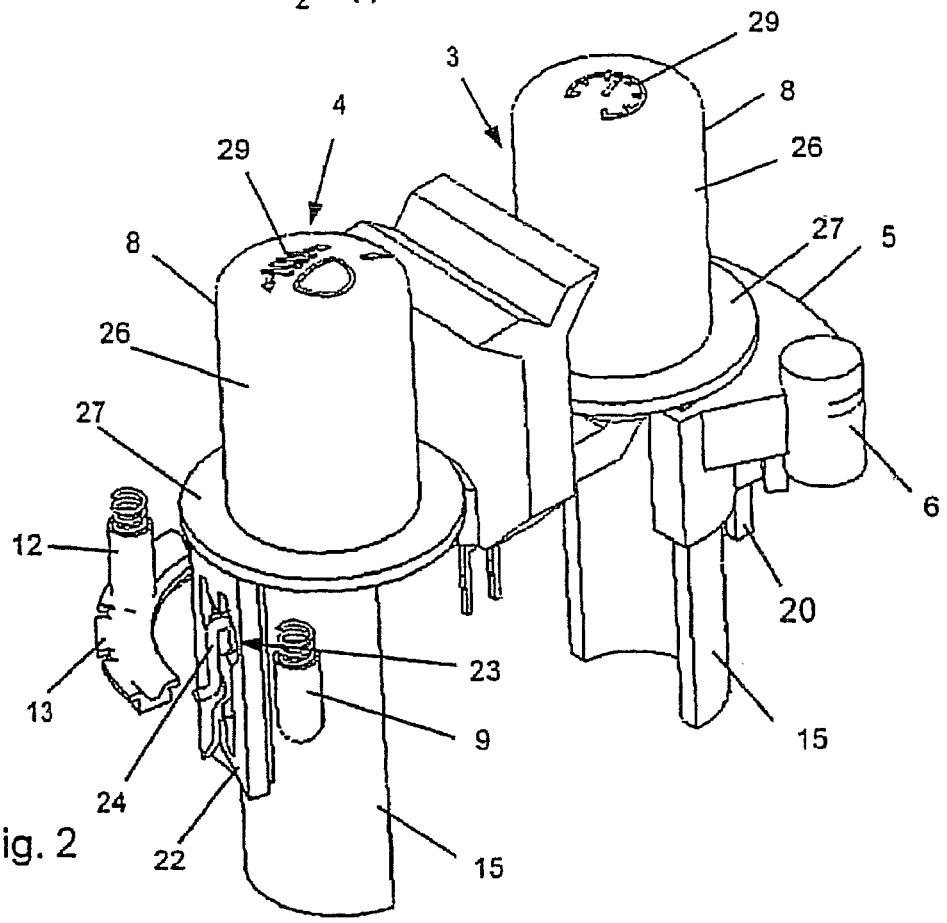
Figure 3:
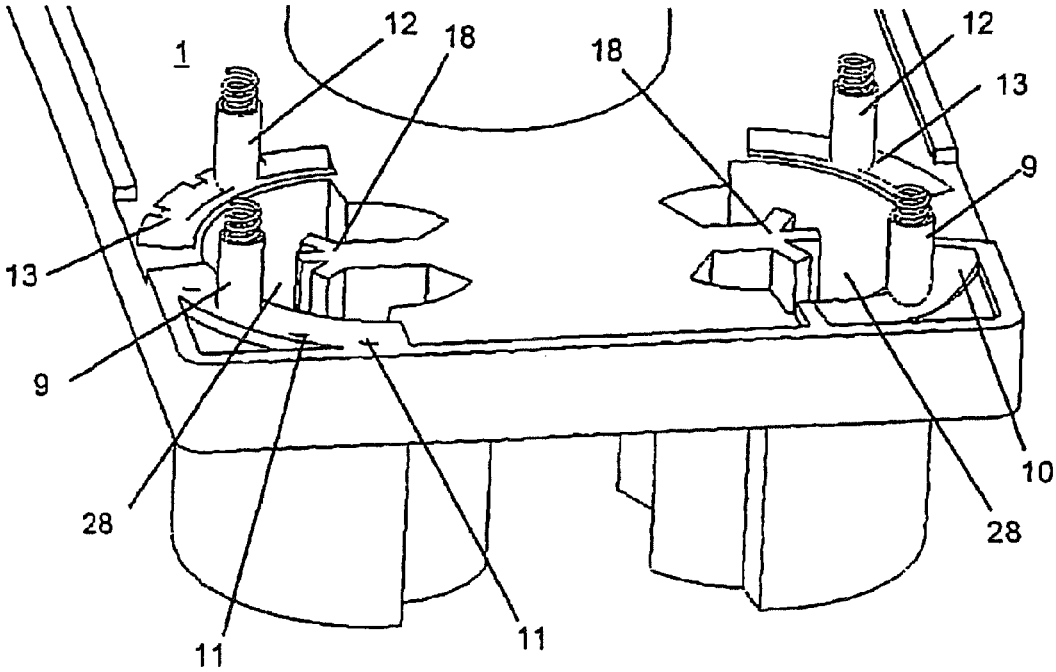
Figure 4:
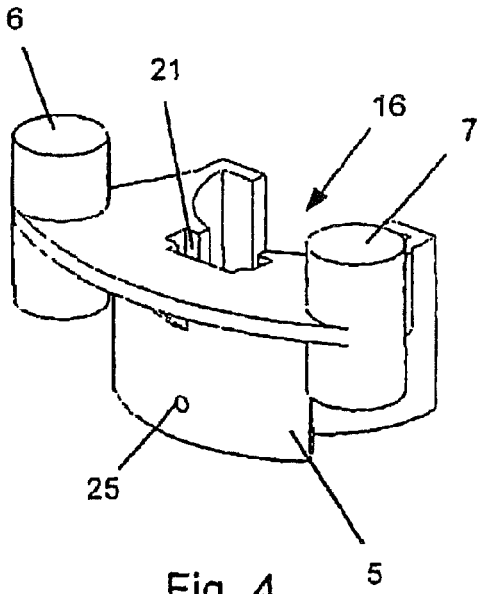
Figure 5:
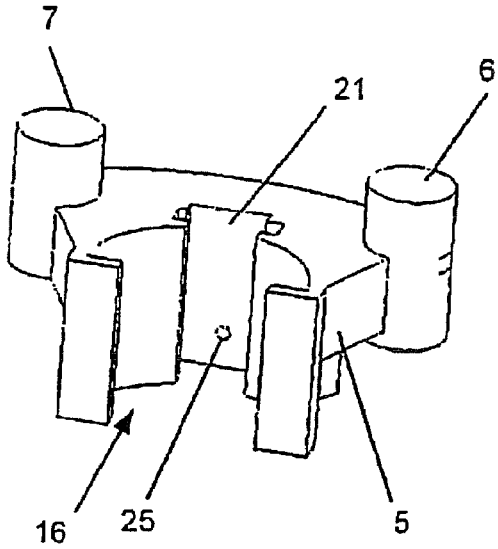
Figure 6:
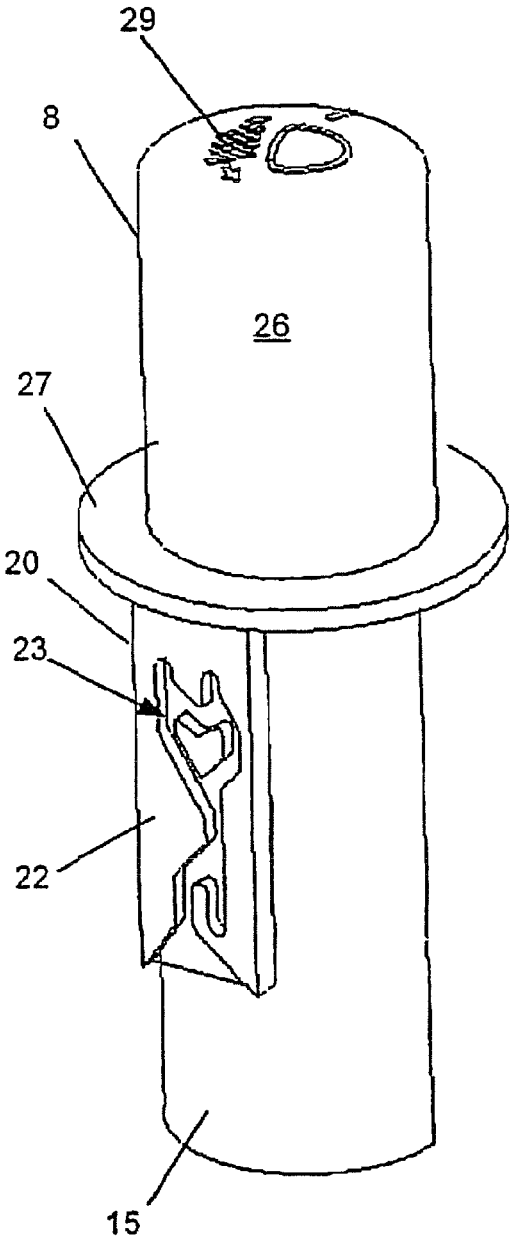
Figure 7:
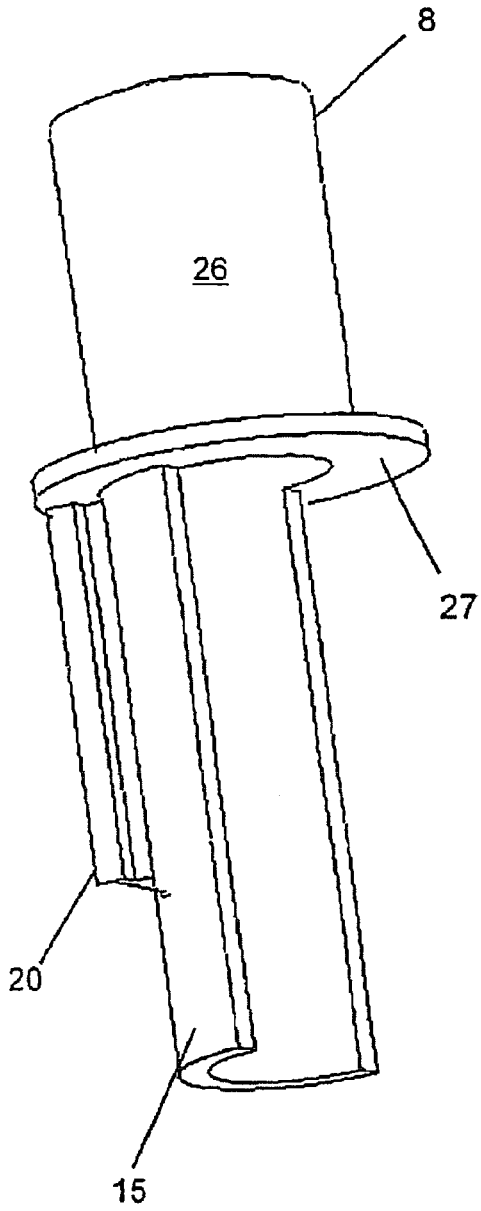
Figure 8:
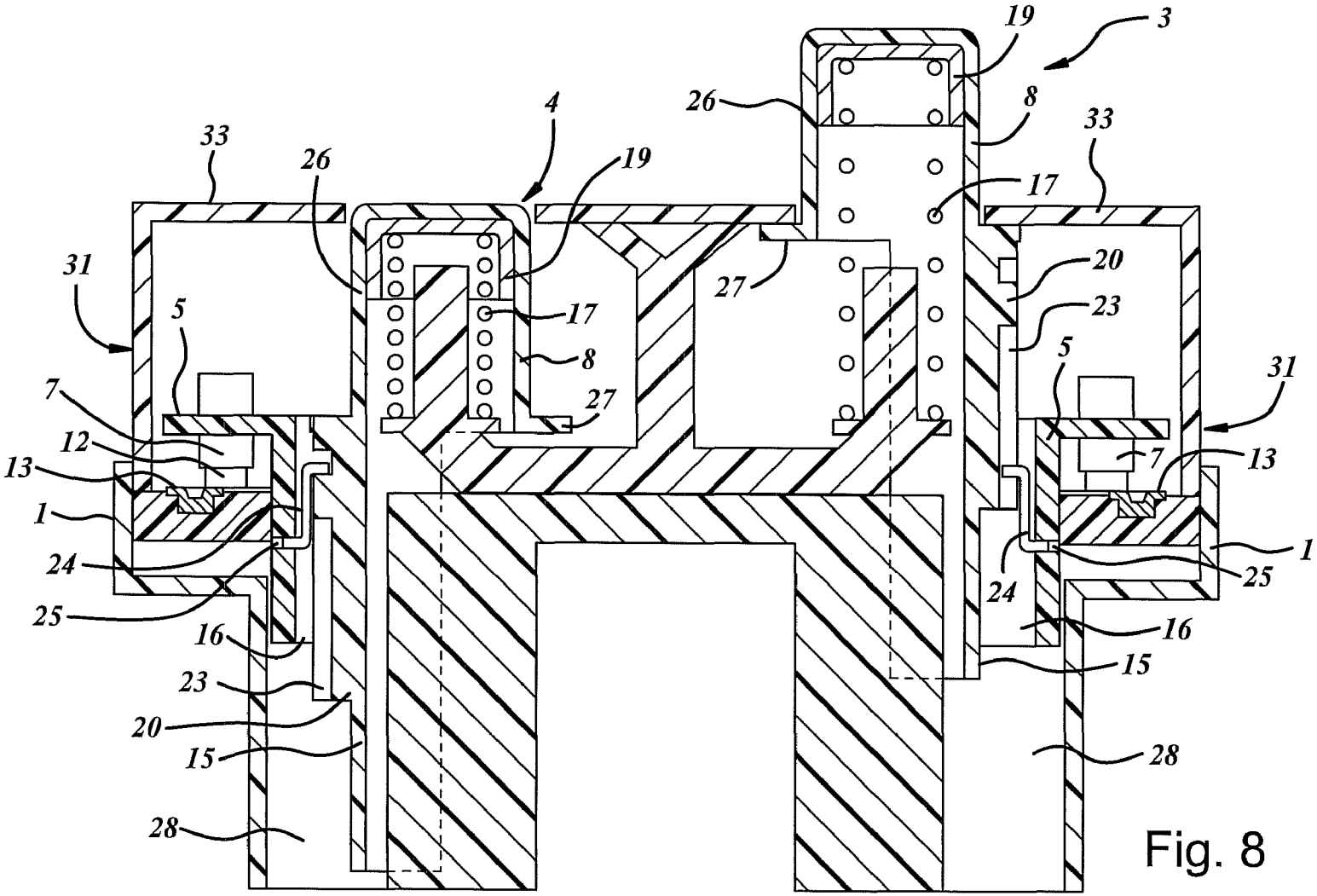
FIG. 8 is a side elevational and segmented view of the switch unit with the housing edge shown with the base and an actuation element in a top end position and another actuation element in a bottom end position with terminating flush with the upper edge.

The switch unit includes a base 1 of a housing 31. Switch contact traces 2 of a printed pattern are assigned to this base and open into connection contacts for connecting to an onboard network of a motor vehicle. Several individual switches, of which two rotary switches 3, 4 are shown, are assigned to the switch unit. One rotary switch 3 assumes keyed switch positions and the other rotary switch 4 assumes latched switch positions. Each of the rotary switches 3, 4 includes an essentially circular cutout-like rotary switching unit 5. Domes 6, 7 are formed at the peripheral corner points of this unit, and an actuation element 8 attaches in the center of this unit. In the first dome 6 of the rotary switching unit 5, a compression spring-loaded locking sleeve 9 is provided. In the keyed configuration of the rotary switch 3, the locking sleeve 9 interacts with a stopping bevel 10 of the base 1. For the latched switch positions of the other rotary switch 4, in the base 1 several indentations 11 are provided on a circular trace, in which the locking sleeves 9 come to lie. In the second dome 7, a cylindrical projection 12 of a switch contact 13 is held in a compression spring-loaded manner. The switch contact 13 has the shape of a circular ring section and interacts with the switch contact traces 2 in the base 1. The actuation element 8 is locked in rotation in a recess 16 of the rotary switching unit 5 by means of a projection 15 provided with a tab 20, wherein the projection 15 of the actuation element 8 is shaped as a semicircular ring in its cross section. A compression spring 17, which is supported, in part, on a connecting piece 18 of the base 1 and, in part, with the intermediate arrangement of a cap 19 on the actuation element 8, is inserted into the center of the projection 15. To transfer rotational movements, the tab 20, which engages in a corresponding groove 21 of the recess 16 of the rotary switching unit 5, is formed on the projection 15 of the actuation element 8. In a radially aligned surface 22 of the tab 20 of the actuation element 8, a cardioid-shaped curve 23 is formed, in which one end of an S-shaped pin 24 engages, whose other end is fixed in a bore 25 in the groove 21 of the rotary switching unit 5. In interaction with the pin 24, in a known way the cardioid-shaped curve 23 causes the locking of the actuation element 8 in a bottom end position when pressure is applied to this actuation element and the release of the locking when pressure is applied to the actuation element 8 again, after which the actuation element 8 is led into its top end position due to the action of the compression spring 17. In the top end position, a cross-sectionally cylindrical gripping surface 26 of the actuation element 8 projects past an upper edge 33 of the housing 31, so that a user of the rotary switch 3, 4 can apply force to this surface. The top end position of the actuation element 8 is limited by an annular shoulder 27 underneath the gripping surface 26, which comes to lie on the housing within the housing. In the bottom end position of the actuation element 8, the annular shoulder 27 lies on the assigned end side of the rotary switching unit 5 and the projection 15 of the actuation element 8 is inserted into a recess 28 of the base 1, which is dimensioned so that rotation of the actuation element 8 is blocked in its bottom end position. For backlighting of a symbol 29 of the actuation element 8, the cap 19 is embodied as an optical fiber. The necessary light radiation is emitted from light elements 30 arranged on the base 1.

For the previously described switch unit, the rotary switch 3 with the keyed switch positions is used for switching a dimming function for instrument lighting, and the rotary switch 4 with the latched switch positions is used for height adjustment of headlights of a motor vehicle.

The invention claimed is:

1. An electric rotary switch with a rotary switching unit being mounted in a housing and having at least one switch contact for acting on switch contact traces assigned to a base, the rotary switching unit being coupled to an actuation element and cooperating with a locking sleeve, bevel or indentation for determining switch positions, allocated in part, to the end side of the rotary switching unit pointing in the direction of the base and, in part, to the base, the electric rotary switch characterized by:

a first dome of the rotary switching unit receiving said locking sleeve and biased by a compression spring received in said first dome;

said locking sleeve interacting with at least one base-side indention or stopping bevel; and said actuation element being mounted so that it can move axially to a bottom end position flush with an upper edge of the housing, wherein a projection of the switch contact is held in a compression spring-loaded manner in a second dome of the rotary switching unit, wherein the rotary switching unit includes a recess used for rotationally fixed holding of the actuation element, wherein a tab engaging in the recess is formed on the actuation element, wherein the actuation element is supported in a compression spring-loaded manner on the base and has a cardioid-shaped curve, in which a rotary switching unit fixed pin engages, in order to hold the actuation element in the bottom end position when pressure is applied and to release the element again when pressure is re-applied, wherein the pin has an S-shape where one end is fixed in the recess of the rotary switching unit and the other end extends above the rotary switching unit into the cardioid-shaped curve of the actuation element, and wherein the cardioid-shaped curve is formed in a tab of the actuation element.

2. The electric rotary switch according to claim 1, characterized in that the actuation element has a projection which engages in the recess of the rotary switching unit, said projection having a cross section being shaped like a semicircular ring.

3. The electric rotary switch according to claim 2, characterized in that a compression spring, which is supported, first, on a connecting piece of the base and, second, under intermediate arrangement of a cap on the actuation element, is inserted into a center of the projection.

4. The electric rotary switch according to claim 3, characterized in that the cap is configured as an optical fiber for backlighting of a symbol of the actuation element.

5. The electric rotary switch according to claim 2, characterized in that the projection of the actuation element is inserted into a recess of the base in order to block rotation of the actuation element when the actuation element is disposed in a bottom end position.

6. The electric rotary switch according to claim 1, characterized in that the actuation element has an annular shoulder which contacts the housing when the actuation element is disposed in a top end position.

7. An electric rotary switch with a rotary switching unit being mounted in a housing and having at least one switch contact for acting on switch contact traces assigned to a base, the rotary switching unit being coupled to an actuation element and cooperating with a locking sleeve, bevel or indentation for determining switch positions, allocated in part, to the end side of the rotary switching unit pointing in the direction of the base and, in part, to the base, the electric rotary switch characterized by:

a first dome of the rotary switching unit receiving said locking sleeve and biased by a compression spring received in said first dome;

said locking sleeve interacting with at least one base-side indention or stopping bevel; and said actuation element being mounted so that it can move axially to a bottom end position flush with an upper edge of the housing, wherein the actuation element is supported in a compression spring-loaded manner on the base and has a cardioid-shaped curve, in which a rotary switching unit fixed pin engages, in order to hold the actuation element in the bottom end position when pressure is applied and to release the element when pressure is reapplied, wherein the cardioid-shaped curve is formed in a tab of the actuation element.

8. The electric rotary switch according to claim 7, characterized in that a compression spring, which is supported, first, on a connecting piece of the base and, second, under intermediate arrangement of a cap on the actuation element, is inserted into a center of a projection of the actuation element.

9. The electric rotary switch according to claim 8, characterized in that the projection of the actuation element is inserted into the bottom end position into a recess of the base where the projection blocks rotation of the actuation element.

* * * * *